US010400479B2

(12) United States Patent
Kang et al.

(10) Patent No.: US 10,400,479 B2
(45) Date of Patent: Sep. 3, 2019

(54) DOOR ZOOM-UP LATCH HAVING ADJUSTABLE BACKSET AND DIGITAL DOOR LOCK DEVICE HAVING SAME

(71) Applicant: Jae-Seok Kang, Seoul (KR)

(72) Inventors: Jae-Seok Kang, Seoul (KR); Jae-Uk Kang, Seoul (KR)

(73) Assignee: Jae-Seok Kang, Seoul (KR)

( * ) Notice: Subject to any disclaimer, the term of this patent is extended or adjusted under 35 U.S.C. 154(b) by 382 days.

(21) Appl. No.: 15/115,936

(22) PCT Filed: Feb. 11, 2015

(86) PCT No.: PCT/KR2015/001370
§ 371 (c)(1),
(2) Date: Aug. 2, 2016

(87) PCT Pub. No.: WO2015/122683
PCT Pub. Date: Aug. 20, 2015

(65) Prior Publication Data

US 2017/0175421 A1 Jun. 22, 2017

(30) Foreign Application Priority Data

Feb. 11, 2014 (KR) ..... 10-2014-0015691

(51) Int. Cl.
*E05B 63/06* (2006.01)
*E05B 55/00* (2006.01)
*E05C 1/12* (2006.01)

(52) U.S. Cl.
CPC ..... *E05B 63/06* (2013.01); *E05B 55/00* (2013.01); *E05C 1/12* (2013.01)

(58) Field of Classification Search
CPC ..... E05B 63/0017; E05B 63/06; E05B 55/00; E05B 63/08; E05B 63/125; E05B 47/00; E05B 47/0046; E05B 17/147; E05B 43/00; E05B 47/0696; E05C 1/12; E05C 1/00; E05C 19/16
USPC ..... 292/1.5
See application file for complete search history.

(56) References Cited

U.S. PATENT DOCUMENTS 2,667,057 A 1/1954 Thorne
6,318,769 B1 * 11/2001 Kang ..... E05B 63/06 292/1.5
6,993,946 B1 * 2/2006 Shen ..... E05B 13/005 292/169.22
7,393,022 B1 7/2008 Shan et al.
(Continued)

FOREIGN PATENT DOCUMENTS

CN 2553039 Y 5/2003
JP 07-045737 Y2 10/1995
(Continued)

*Primary Examiner* — Nathan Cumar
(74) *Attorney, Agent, or Firm* — Rabin & Berdo, P.C.

(57) ABSTRACT

The present disclosure relates to a door lock device, and more specifically, to a backset adjustable door zoom up latch capable of adjusting a backset distance according to a variety of backset standards of the door, and a digital door lock device having the same. Accordingly, the backset adjustable locking device according to the present disclosure includes a latch, a holder inserted into the latch, an elastic member installed between the latch and the holder, and a zoom guide inserted into the latch and fastened with the holder to fix the latch to the holder.

8 Claims, 15 Drawing Sheets

(56) References Cited

U.S. PATENT DOCUMENTS

| | | | | |
|---|---|---|---|---|
| 8,141,400 | B2 * | 3/2012 | Sorensen | E05B 47/068 340/5.54 |
| 2010/0263418 | A1 * | 10/2010 | Moon | E05B 55/00 70/107 |
| 2011/0094975 | A1 * | 4/2011 | Hardy | A47F 1/12 211/4 |

FOREIGN PATENT DOCUMENTS

| | | | |
|---|---|---|---|
| JP | 2007-197904 | A | 8/2007 |
| JP | 2007-205112 | A | 8/2007 |
| JP | 2009-154787 | A | 7/2009 |
| KR | 20-1988-0018086 | U | 10/1988 |
| KR | 20-1999-0038232 | U | 10/1999 |
| KR | 20-0346997 | Y1 | 4/2004 |
| KR | 10-2005-0036520 | A | 4/2005 |
| KR | 10-0913064 | B1 | 8/2009 |

* cited by examiner (a)

(b)

(a)

(b)

(a)

(b)

(a)

(b)

(a)

(b)

(a)

(b)

DOOR ZOOM-UP LATCH HAVING ADJUSTABLE BACKSET AND DIGITAL DOOR LOCK DEVICE HAVING SAME

TECHNICAL FIELD

The present disclosure relates to a door locking device, and more particularly, to a backset adjustable door zoom up latch, which is capable of adjusting a backset distance to correspond to a variety of backset specifications of a door, and a digital door locking device having the same.

BACKGROUND ART

Generally, a locking device or a door latch provided for a door includes a latch bolt unit installed on an inner side surface of the door to move forward (project) or move backward (retract) in accordance with a rotation of a door outer lever type or a round-shaped ball handle. The projecting movement of the latch bolt unit refers to a movement of popping out of the door, while the retracting movement of the latch bolt unit refers to a movement of entering inside the door.

Such latch bolt unit has a front end having a curved portion that is rounded such that automatic door closing is enabled even when the door in a projected state is closed without the lever operation, because the inclined surface is brought into contact with the threshold or a wall and retracted automatically.

A latch bolt unit insertion hole is formed in the doorframe or the wall to receive the latch bolt unit inserted therein and this structure allows the latch bolt unit to be inserted into the latch bolt unit insertion hole upon door closing. Accordingly, as described above, even when the door is closed without lever turning, the latch bolt unit is pushed by the doorframe or wall to be automatically retracted and when moved to a location where the bolt insertion hole is formed in the doorframe or the wall, the latch bolt unit is projected outward by the elastic returning force of an internally-loaded spring to thus maintain the door in the closed state.

Once a locking device is operated with the door being kept in the closed state in the manner described above, it is impossible to open the door from outside by turning the lever. In order to release the lock, manipulation inside the door to unlock, or manipulation with a key outside the door to unlock is necessary.

However, the presence of the inclined surface of the latch bolt unit allows an external intruder to retract the latch bolt unit by force by forcefully inserting a plastic card or other member through a chink of the door from outside, thus forcefully unlocking the locked state. This would cause safety issues.

A door is classified into a left handed door opened in a left-arm direction, and a right handed door opened in a right-arm direction. Because a door latch (i.e., locking device) has an opposite direction of installation according to whether the door is the left handed door or the right handed door, the direction of rotation of the lever is reversed with respect to the door latch. Accordingly, installations and uses of the door latch for one single direction are limited, as the door latch is designed for either the left handed door or the right handed door.

A hole for installation purpose is formed in an entrance door when a door lock is installed on the entrance door, and there are mainly two types of standardized entrance doors that have about 60 mm or about 70 mm of backset (i.e., distance from an edge of the entrance door to the center of the hole for installation).

Accordingly, it is inconvenient because the respective door latches have to be prepared to conform to various backset standards of the doors. An adjustable backset is thus necessary for the door latch to allow universal installation and use thereof, irrespective of the different backset standards of the entrance doors. However, a door latch provided with adjustable backset is not disclosed yet.

DISCLOSURE OF INVENTION

Technical Problem

An object of the present disclosure is to solve the problems mentioned above, and accordingly, it is an object of the present disclosure to provide a locking device capable of adjusting a backset distance to correspond to a variety of backset standards of doors.

It is another object of the present disclosure to provide a locking device capable of rotating in both forward and backward directions according to a left handed door and a right handed door.

It is yet another object of the present disclosure to provide a locking device capable of performing both a dead bolt function and a latch bolt function at the same time.

Means to Solve the Problem

In order to achieve the above and other objects, in an exemplary embodiment, a locking device capable of adjusting a backset is provided, which may include a latch, a holder inserted into the latch, an elastic member installed between the latch and the holder, and a zoom guide inserted into the latch and fastened with the holder to fix the latch to the holder.

According to an exemplary embodiment, a locking device may include a latch, a holder inserted into the latch, and a main body to which the holder is inserted, and the main body may include a cam interoperated with a rotation of a lever, a link arm rotated in a direction opposite a rotation of the cam, an arm rotated in a direction opposite the rotation of the link arm, and a holder stopper moved along with the holder. During a forward rotation of the lever, a first cam protrusion provided on the cam pushes a first contact surface of the link arm such that the link arm is rotated, and a link arm stopper provided on the link arm is rotated and the holder stopper is changed from a state of being restricted from moving by the link arm stopper to a state of being unstopped by the link arm stopper, and as the link arm stopper is continuously rotated to thus push a first surface of the arm, the arm is rotated such that a second surface of the arm pushes the holder stopper and the holder enters into the main body.

Further, according to an exemplary embodiment, a locking device may include a latch, a holder inserted into the latch, and a main body to which the holder is inserted, and the main body may include a time lock interoperating with the holder. When the holder is moved into the main body by a rotation of a lever, a time lock is moved along a rail of the holder from a contact with the holder to an end of the rail, and when the lever is let free, the holder is projected out of the main body and the time lock is moved from the end of the rail, past a first surface of a time lock locking jaw, to be locked in a second surface of the time lock locking jaw.

Further, according to an exemplary embodiment, a door lock device is provided, which may include an inner device comprising an inner lever fixture installed on an inner wall of a door, an inner lever rotatably coupled with the inner lever fixture, and an inner rotatable bar installed at a center of the inner lever fixture, an outer device comprising an outer lever fixture installed on an outer wall of the door, an outer lever rotatably coupled with the outer lever fixture, and an outer rotatable bar installed at a center of the outer lever fixture, and a locking device interoperating with a rotation of the inner lever and the outer lever. When the inner rotatable bar and the outer rotatable bar are inserted into an interoperation hole provided in the locking device, a first power/signal terminal provided in the interoperation hole and a second power/signal terminal provided on the inner rotatable bar and the outer rotatable bar are electrically interconnected to each other.

Advantageous Effect

According to various exemplary embodiments, a zoom guide that fastens the latch with the holder is used to adjust the backset distance such that a reduced number of parts are used, with a simpler assembly process, and the structural strength is reinforced.

Further, the locking device according to various exemplary embodiments have a lever with a function of rotating in a forward direction and a reverse direction, and thus is applicable to a variety of doors and provides enhanced convenience of installation.

Further, the locking device according to various exemplary embodiment uses a time lock such that it is in the dead bolt function state when the door is closed, then performs latch bolt function when the door is opened and then closed, and then automatically changed to the dead bolt function state upon closing of the door.

Further, the locking device according to various exemplary embodiments has a recess provided to delay a movement of the time lock by the time lock locking jaw such that in case when the latch is pressed by the doorframe but the door is not closed and popped open, or when the latch is pressed by a body part of the user, and so on, the latch is prevented from changing to the dead bolt function.

Further, the door lock device according to various exemplary embodiments is provided with a power/signal terminal in the interoperation hole of the locking device, to be electrically interconnected with the inner and outer levers connected to the locking device. Accordingly, power supply and data communication between the inner and outer levers are enabled.

BEST MODE FOR THE INVENTION

Figure 1:
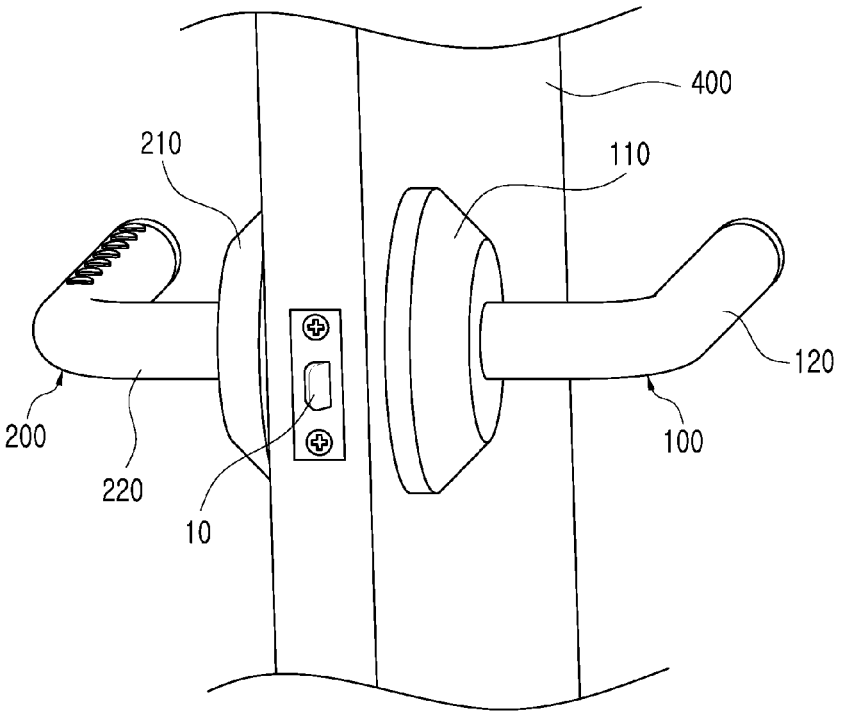
FIG. 1 is a perspective view illustrating a digital door locking device installed on a door according to an exemplary embodiment.

Certain exemplary embodiments of the present inventive concept will be described in greater detail with reference to the accompanying drawings to enable those skilled in the art to work the present disclosure.

However, it is not intended to limit the technology described herein to any specific embodiments, as it should be construed as encompassing various modifications, equivalents and/or alternatives of the embodiments. In the following description, issues irrelevant with the description are not described as these may obscure the description, and same drawing reference numerals are used for the same elements even in different drawings.

Figure 2:
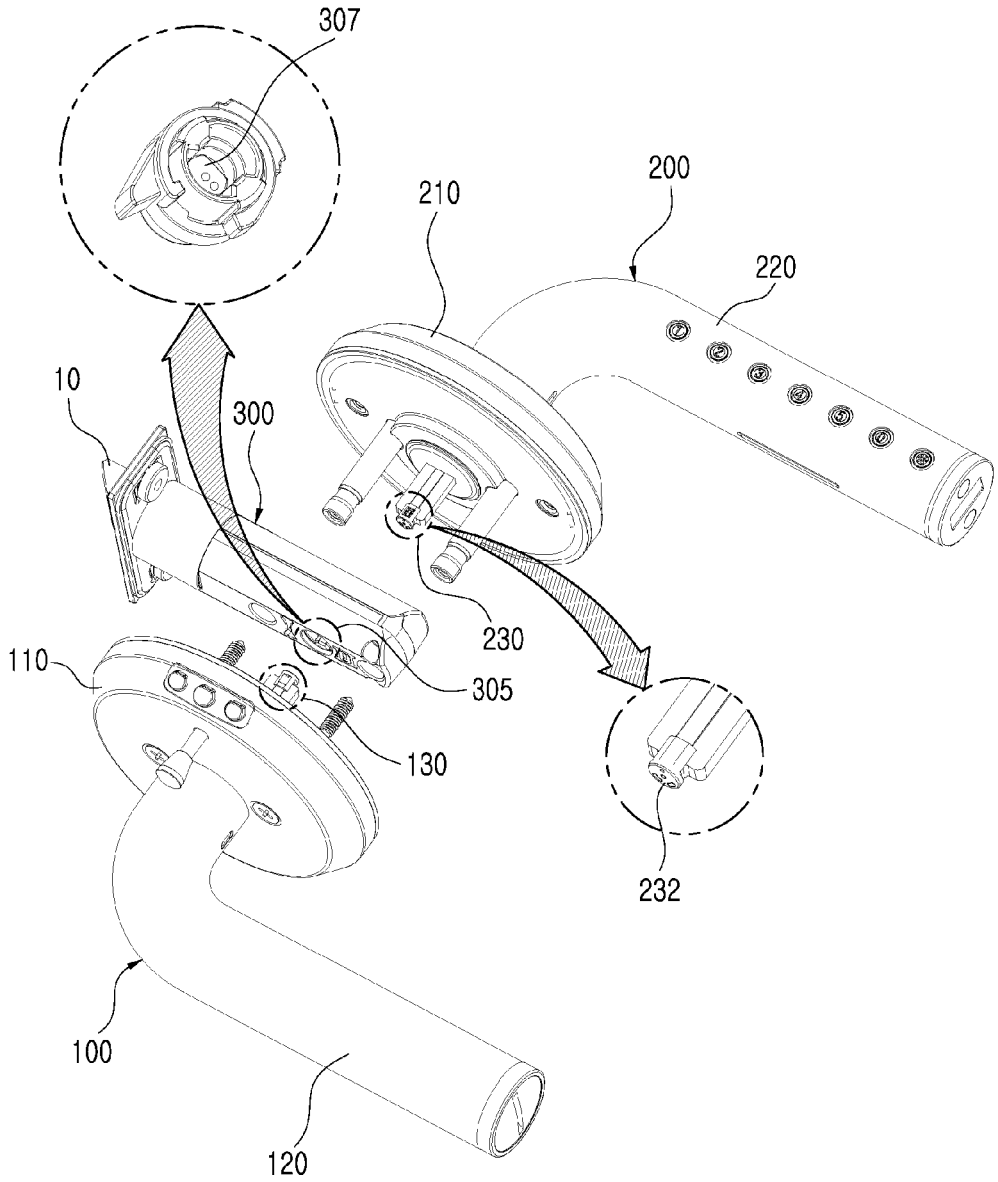
FIG. 2 is an exploded perspective view of a digital door locking device according to an exemplary embodiment.

FIG. 1 is a perspective view illustrating a digital door locking device installed on a door according to an exemplary embodiment, and FIG. 2 is an exploded perspective view of a digital door locking device according to an exemplary embodiment.

Referring to FIGS. 1 and 2, a digital door locking device mainly includes an inner device 100, an outer device 200, and a locking device 300.

The inner device 100 is the device installed inside the door 400. The inner device 100 is attached onto an inner wall of the door, and includes an inner lever fixture 110 including therein a variety of electronic parts and a rotatable structure, an inner lever 120 rotatably coupled with the inner lever fixture 110, an inner rotatable bar 130 installed at an inner center of the inner lever fixture 110 to be rotated by the inner lever 120, and so on.

The outer device 200 is the device installed outside the door 400 and has a similar configuration as the inner device 100. The outer device 200 is attached onto an outer wall of the door and includes an outer lever fixture 210 including therein a variety of electronic parts and rotatable structure, an outer lever 220 rotatably coupled with the outer lever fixture 210, an outer rotatable bar 230 installed at an inner center of the outer lever fixture 210 to be rotated by the outer lever 220, and so on.

The locking device 300 is inserted into a hole provided in a corner of the door, and it plays a role of locking or unlocking the door according to the forward or backward movement of the latch 10. According to the exemplary embodiment, the locking device 300 is a door zoom up latch in a simple configuration that is capable of adjusting a backset distance, and this will be described in detail below.

When the inner device 100 and the outer device 200 are installed inside and outside the door 400, the inner rotatable bar 130 and the outer rotatable bar 230 are inserted in the interoperating hole 305 of the locking device 300, and a power/signal terminal 307 provided in the interoperating hole 305 is electrically interconnected with a power/signal terminal 232 provided in the rotatable bars 130, 230. Accordingly, the voltage from an internal battery (not illustrated) of the inner device 100 is supplied to the electronic parts of the outer device 200, and data communications between the inner device 100 and the outer device 200 can be performed.

Figure 3:
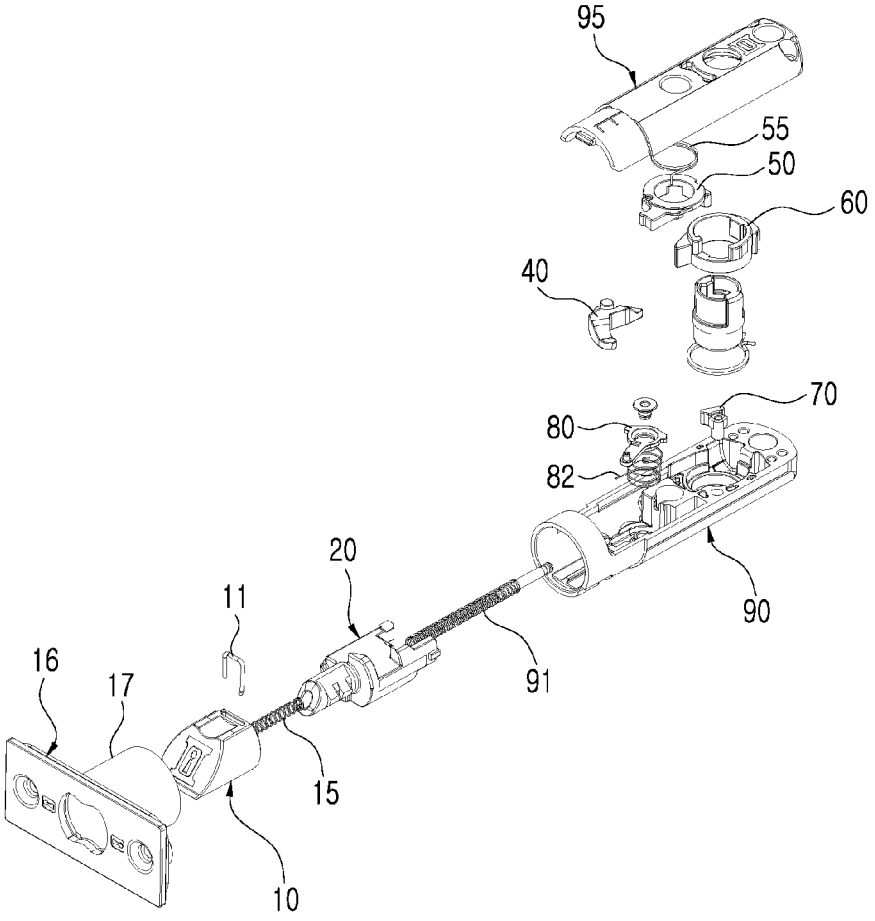
FIG. 3 is an exploded perspective of a locking device according to an exemplary embodiment.
Figure 4:
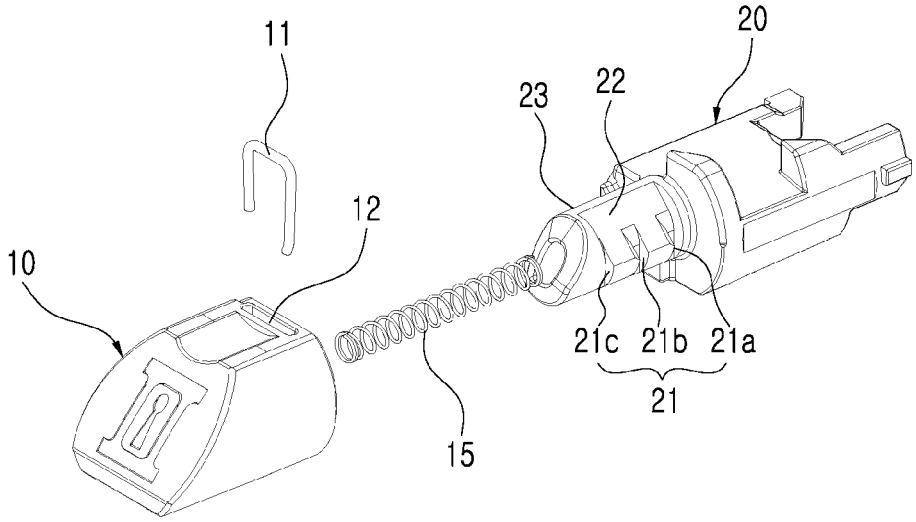
FIG. 4 is an exploded perspective view of a portion for adjusting the backset distance in FIG. 3.

FIG. 3 is an exploded perspective of a locking device according to an exemplary embodiment, and FIG. 4 is an exploded perspective view of a portion for adjusting the backset distance in FIG. 3.

Referring to FIGS. 3 and 4, the locking device 300 is mainly composed of a latch 10, a holder 20 inserted into the latch 10, a main body 90 to which the holder 20 is inserted, and a cover 96 covering the main body 90. A variety of mechanical parts are received in the main body 90, and the types and operations of these parts will be described below.

The portion of the locking device 300 for adjusting the backset distance needs a reduced number of parts and simpler assembly process, and has a reinforced structural strength.

The holder 20 has a latch insert 23 on a front end thereof to be inserted into the latch 10. The latch insert 23 has a 45-degree inclined surface 22 in the lengthwise direction. The inclined surface 22 has backset adjusting grooves 21 at a predetermined distance (e.g., 5 mm) to fasten the zoom guide 11. When the zoom guide 11 is fastened in the backset adjusting groove 21*a*, the backset distance may be adjusted to 60 mm, or when the zoom guide 11 is fastened in the backset adjusting groove 21*b*, the backset distance may be adjusted to 65 mm, or when the zoom guide 11 is fastened in the backset adjusting groove 21*c*, the backset distance may be adjusted to 70 mm.

When the latch 10 and the holder 20 are engaged, the zoom guide 11 inserted into the zoom guide groove 12 is fit in the backset adjusting groove 21 such that the zoom guide 11, which is subject to a returning force of the zoom spring 15 disposed between the latch 10 and the holder 20 and pushing the latch 10, fixes the latch 10 at the holder 20.

Figure 8:
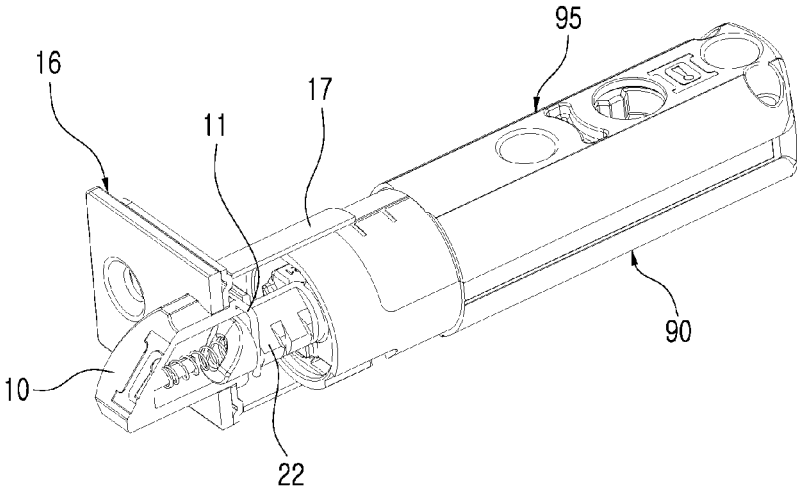
Figure 8:
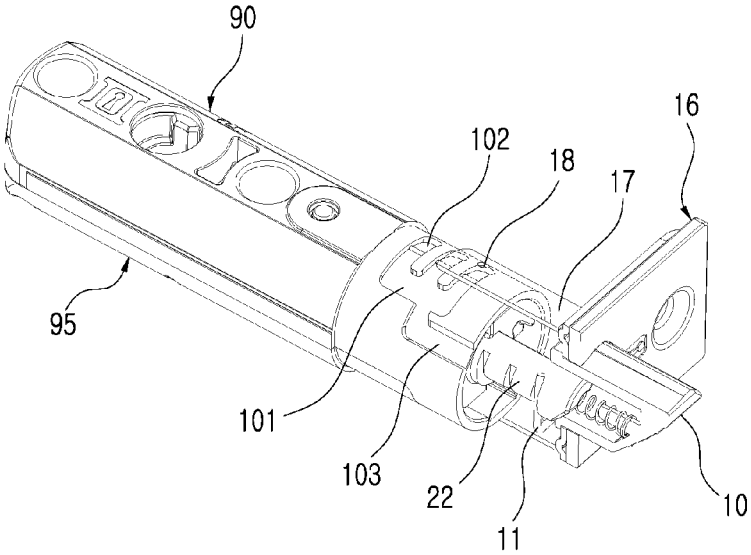
Figure 9:
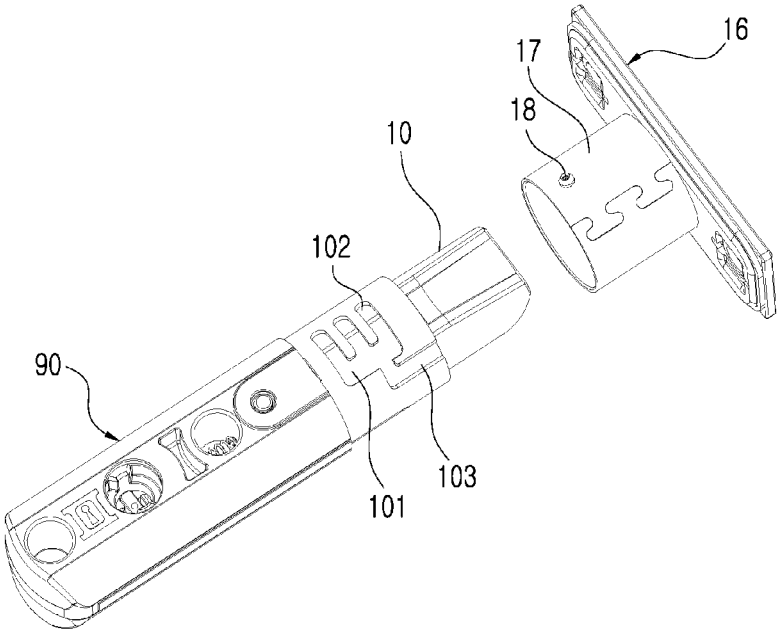
FIG. 9 is a perspective view of a main body and a bracket being in separated state.
Figure 9:
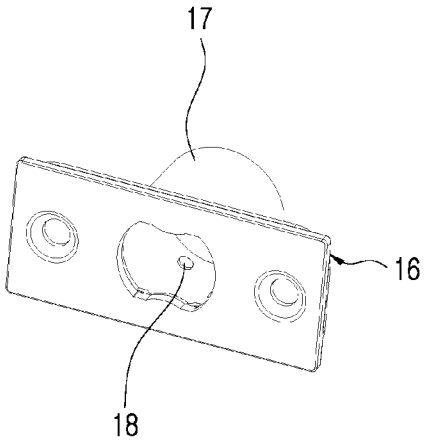

FIGS. 5 to 8 are perspective views illustrating changing shape of a locking device when the backset distance is being adjusted, and FIG. 9 is a perspective view of a main body and a bracket being in separated state.

Figure 5:
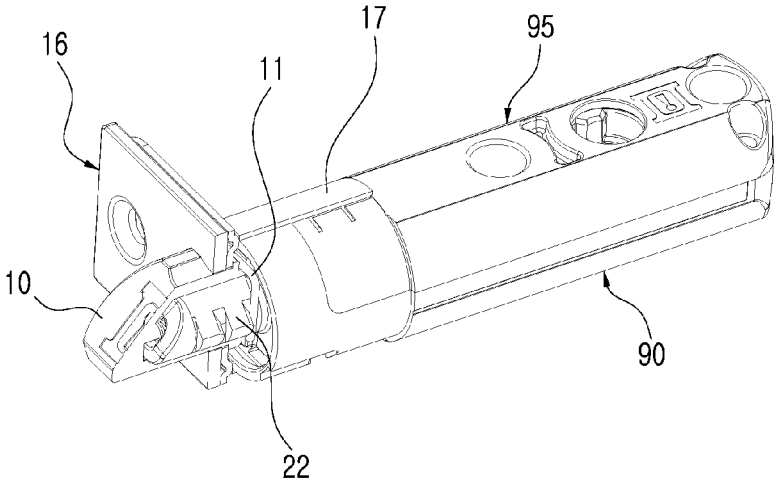
FIGS. 5 to 8 are perspective views illustrating changing shape of a locking device when the backset distance is being adjusted.
Figure 5:
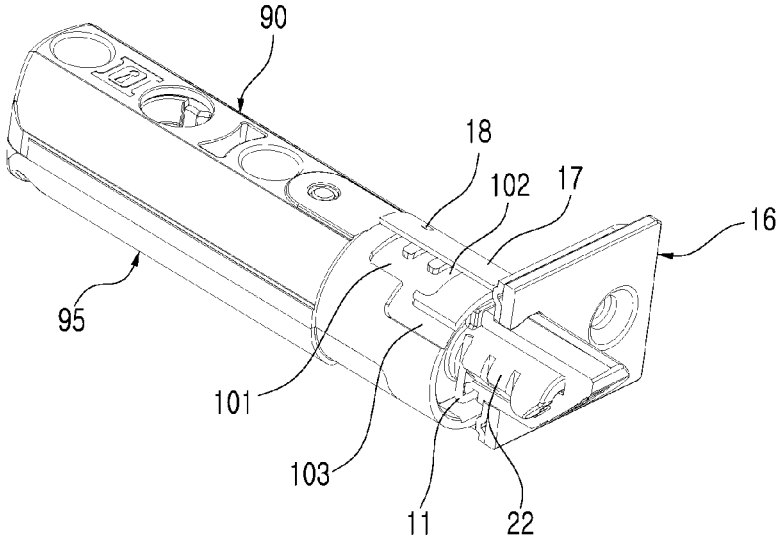
Figure 6:
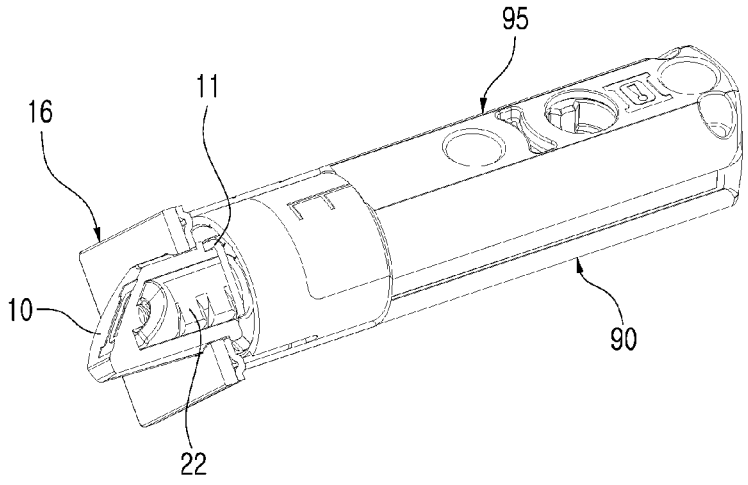
Figure 6:
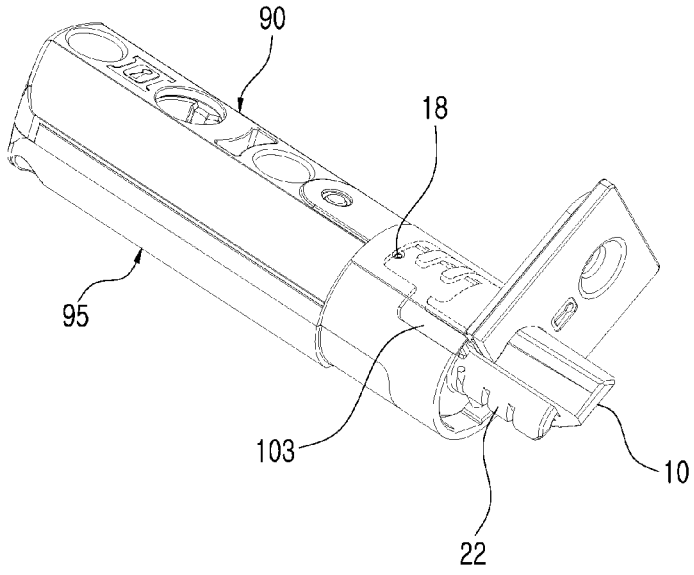
Figure 7:
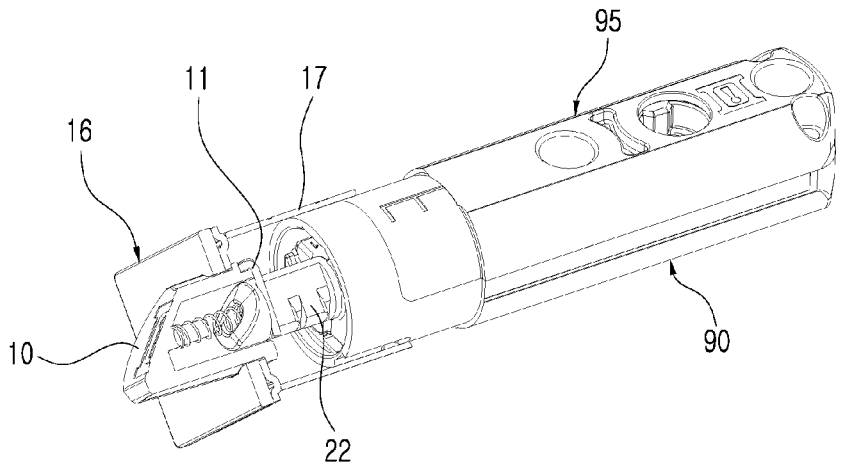
Figure 7:
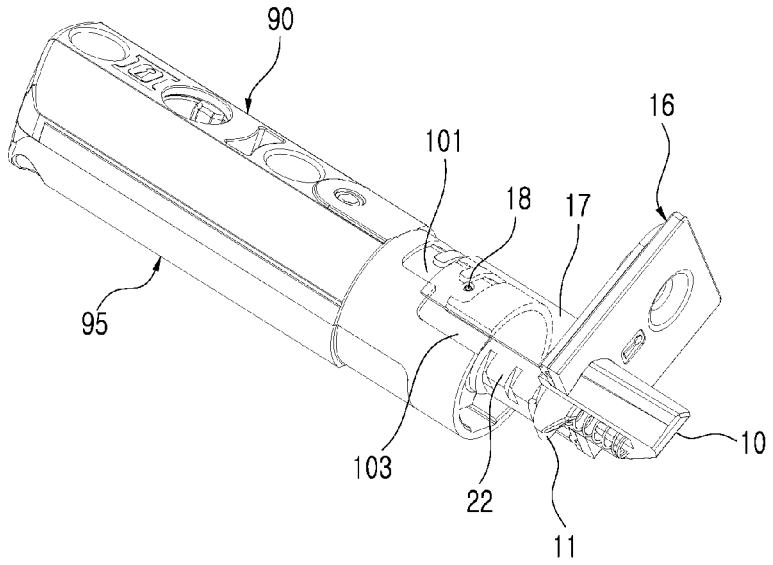

Referring to FIGS. 5 to 9, the backset distance 60 mm is when the zoom guide 11 is in the state of being inserted into the backset adjusting groove 21*a* (see FIG. 5). When the user rotates the bracket 16 counterclockwise by 45 degrees, the bracket 16 rotates the latch 10 such that the zoom guide 11 engaged with the latch 10 is rotated to the inclination that matches that of the inclined surface 22 of the latch insert 23. Accordingly, locking is released and the latch 10 is released from the backset adjusting groove 21*a* (see FIG. 6).

The latch 10, which is unlocked, is projected to the front direction by the zoom spring 15 (see FIG. 7), and as the user positions the zoom guide 11 in the backset adjusting groove 21*b* or the backset adjusting groove 21*c* and rotates the bracket 16 by 45 degrees according to the backset distance to which he or she intends to adjust, the zoom guide 11 is fit into the corresponding backset adjusting groove 21 and the latch 10 is fixed accordingly (see FIG. 8). By this process, the distance between the latch 10 and the holder 20 is increased as long as the backset distance.

To describe adjusting the backset distance by the rotation of the bracket 16 in FIG. 9 more specifically, first, when the bracket 16 and the main body 90 are engaged, the cylinder guide 18 inside the bracket cylinder 17 is advanced along the first guide groove 103 and enters the second guide groove 101, and then moved along the second guide groove 101 to be fastened into the fastening groove 102.

During the backset distance adjustment, the bracket 16 is rotated such that when the cylinder guide 18 is separated from the fastening groove 102 and enters the second guide groove 101, the cylinder guide 18 is moved along the second guide groove 101 and then enters the fastening groove 102 corresponding to the desired backset distance and fastened therein.

When the backset distance is 60 mm, the cylinder guide 18 is positioned as illustrated in FIG. 5B, and when the bracket 16 is rotated by 45 degrees, the cylinder guide 18 is positioned in the second guide groove 101 as illustrated in FIG. 6B. When the latch 10 is projected by the backset distance (i.e., 70 mm), the cylinder guide 18 is moved as illustrated in FIG. 7B. Next, when the bracket 16 is rotated reversely by 45 degrees, the cylinder guide 18 is fastened into the fastening groove 102 corresponding to the backset distance 70 mm as illustrated in FIG. 8B, according to which the main body 90 and the bracket 16 are separated and fixed. The process described above may be reversed in order to reduce the backset distance.

When the door lock is installed, the direction of the rotation of the door lock lever is reversed depending on whether the door is a left handed door or a right handed door. According to an exemplary embodiment, the locking device 300 is equipped with a forward and reverse rotational function of the lever such that it can be applied to a variety of doors and can enhance convenience of installation.

FIGS. 10 to 14 are views illustrating an internal structure of a main body to achieve forward and reverse rotational functions of a locking device according to an exemplary embodiment.

Figure 10:
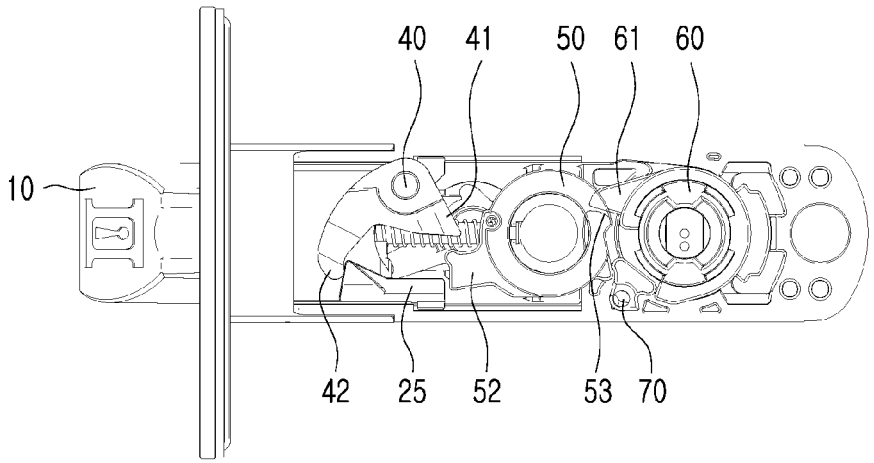
FIGS. 10 to 14 are views illustrating an internal structure of a main body to achieve forward and reverse rotational function of a locking device according to an exemplary embodiment.
Figure 11:
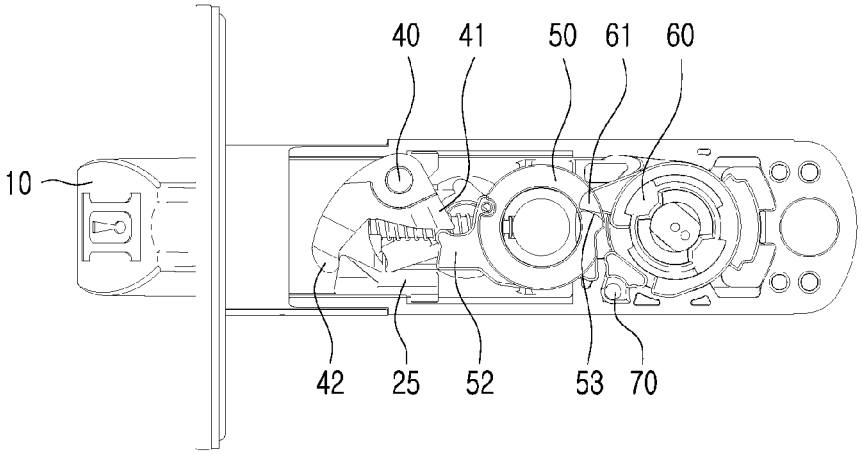

FIG. 10 illustrates an initial state, i.e., before the lever of the door lock is rotated. In this state, the link arm 50 maintains the state shown in FIG. 10 by the link arm spring 55 such that, when the latch 10 is subject to a force moving into the main body 90, it becomes the dead bolt state in which the holder stopper 25 is stopped at the link arm stopper 52 and the latch 10 is restricted from entering the main body 90.

When the lever of the door lock is rotated by the user in the forward direction (i.e., counterclockwise direction), the lever causes the cam 60 to rotate such that the first cam protrusion 61 formed on the cam 60 pushes the first contact surface 53 of the link arm 50, thus rotating the link arm 50. As a result, the link arm stopper 52 of the link arm 50 is rotated.

As the link arm stopper 52 is rotated, the holder stopper 25 is changed from the state of being restricted from moving by the link arm stopper 52 to the state of being unstopped by the link arm stopper 52. As a result, locking is released. When the lever is continuously rotated, the arm 40 of the link arm 50 pushes the first surface 41 such that the arm 40 is rotated, and as the second surface 42 of the arm 40 pushes the holder stopper 25, the holder 20 enters into the main body 90 (see FIG. 12).

Figure 13:
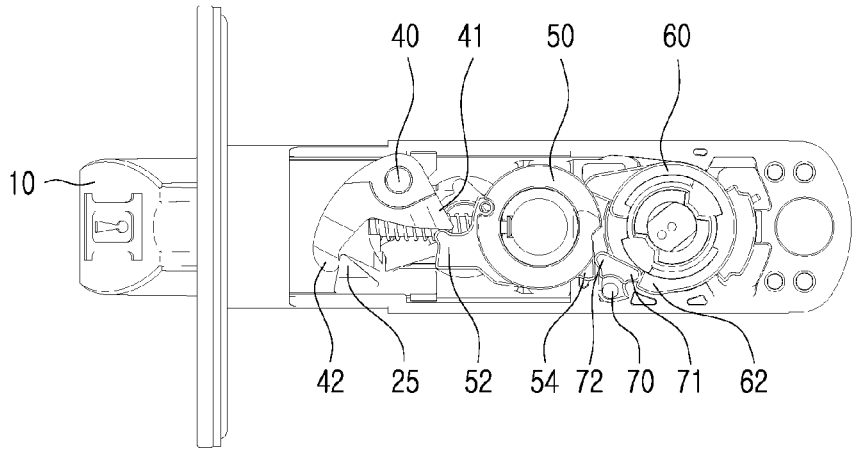

Then when the lever of the door lock is rotated in the reverse direction (i.e., clockwise direction) by the user, as illustrated in FIG. 13, the cam 60 is rotated by the lever such that the second cam protrusion 62 provided on the cam 60 pushes the first surface 71 of the counter arm 70. Accordingly, the counter arm 70 is rotated such that the second surface 72 of the counter arm 70 pushes the second contact surface 54 of the link arm 50.

The link arm stopper 52 is then rotated like the forward rotation of the lever such that the holder stopper 25, which was restricted from moving by the link arm stopper 52, is changed to the state of being unstopped by the link arm stopper 52, and accordingly, locking is released. Then as the lever is continuously rotated, the link arm 50 pushes the first surface 41 of the arm 40 such that the arm 40 is rotated and the second surface 42 of the arm 40 pushes the holder stopper 25. Accordingly, the holder 20 enters into the main body 90 (see FIG. 14).

As described above, regardless of whether the lever of the door is rotated in the forward direction or the reverse direction, locking by the holder stopper 25 is released and the holder 20 is entered into the main body 90 by the holder stopper 25 such that the rotation of the door lock lever in both the forward and reverse directions is enabled.

Further, the locking device 300 according to an exemplary embodiment has the latch 10 in the dead bolt state when the door is closed, then the latch 10 performs the latch bolt function in the process of door opening and closing, and then the latch 10 is automatically changed from the latch bolt function to the dead bolt function upon closing of the door.

Figure 15:
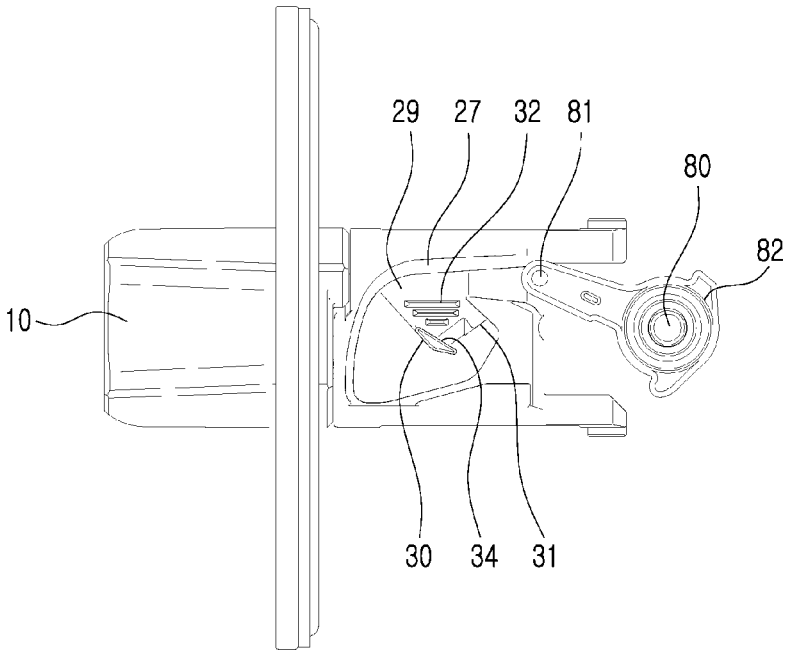
FIGS. 15 and 16 are views illustrating a locking device being in dead bold function state according to an exemplary embodiment.
Figure 15:
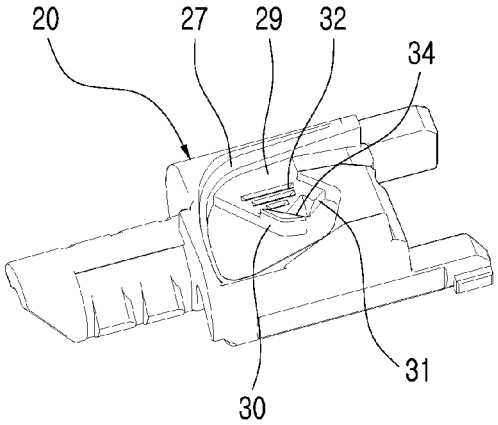
Figure 16:
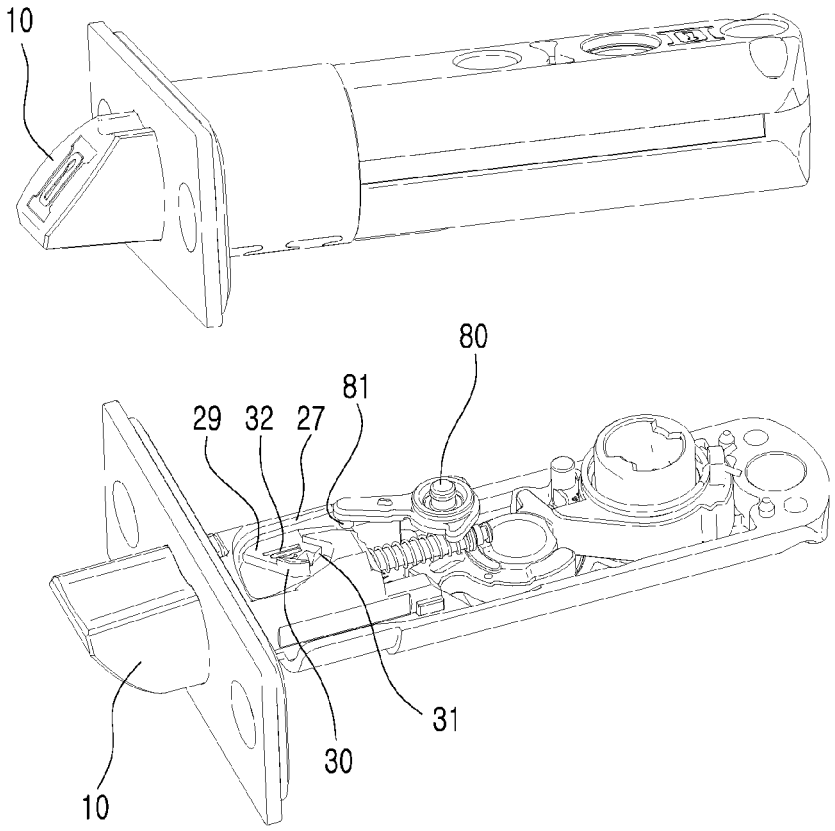
Figure 17:
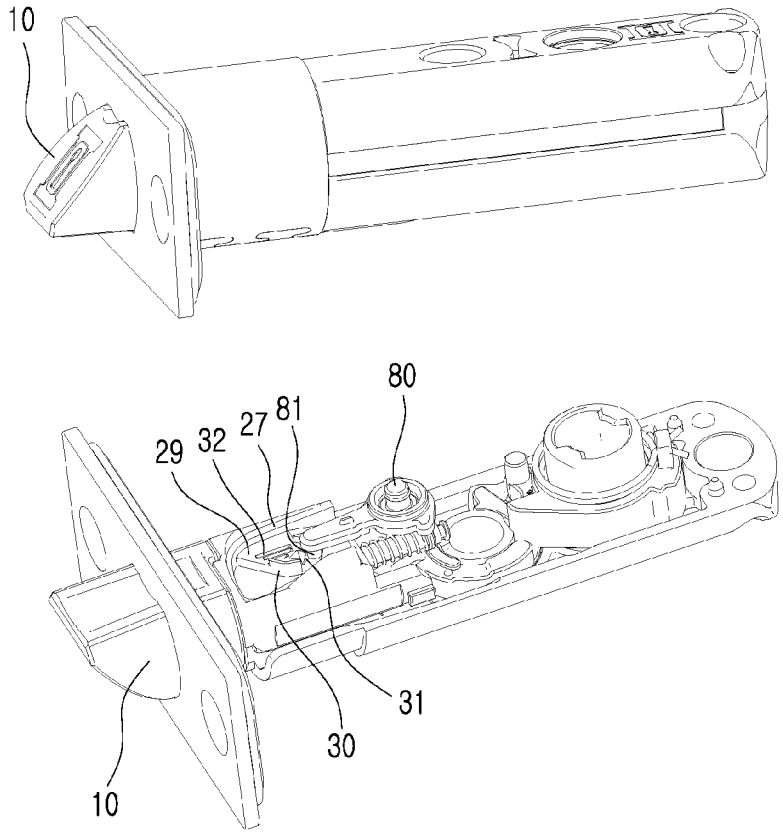
FIG. 17 is a view illustrating a locking device being in latch bolt function state according to an exemplary embodiment.

FIGS. 15 and 16 are views illustrating a locking device being in dead bold function state according to an exemplary embodiment, and FIG. 17 is a view illustrating a locking device being in latch bolt function state according to an exemplary embodiment.

Referring to FIGS. 15 and 16, the time lock 80 is subject to a force by the time lock spring 82 that urges it 80 into contact with the rail 27 of the holder 20 such that the time lock protrusion 81 formed in a lengthwise member of the time lock 80 is in contact with the rail 27.

Figure 12:
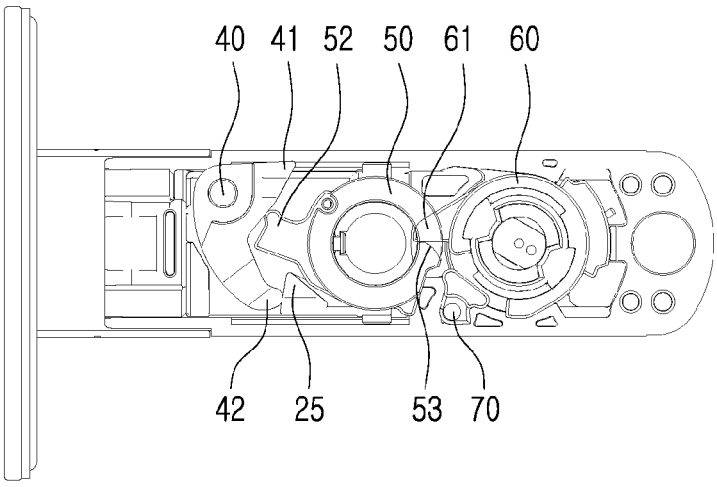
Figure 14:
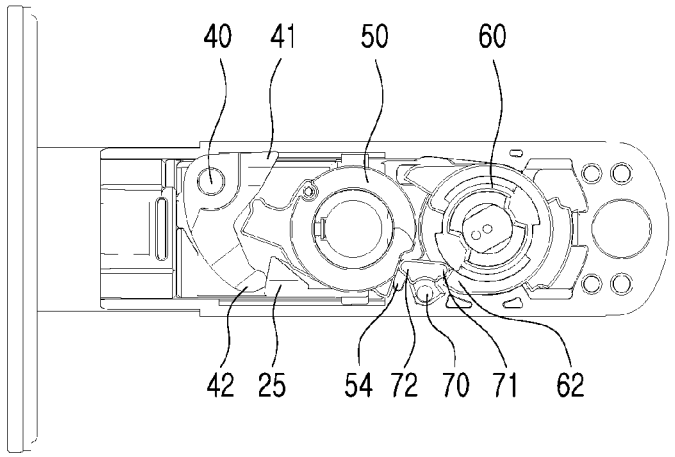

When the lever of the door lock is rotated to open the door, as illustrated in FIG. 12 or FIG. 14, the latch 10 is moved into the main body 90 as much as possible, and the time lock protrusion 81 is moved along the rail 27 to the end of the rail 27. When the lever of the door lock is let free, the latch 10 and the holder 20 are projected out of the main body 90 by the holder spring 91 such that the time lock protrusion 81 is moved past the first surface 30 of the time lock locking jaw 29 and locked in the second surface 31 of the time lock locking jaw 29 (see FIG. 17). This is the single end projection state, which is the latch bold function state.

When the user pushes the door to close in the single end projection state, the inclined surface of the latch 10 is collided against the doorframe of the door and slid such that the latch 10 is moved into the main body 90. At this time, the time lock protrusion 81 is moved by the force of the time lock spring 82 along the guide surface 34 of the time lock locking jaw 29 and brought into contact with the rail 27 abutting the time lock locking jaw 29. Then as the latch 10 is in alignment with the location of the doorframe hole of the door, the latch 10 is projected by the holder spring 91 such that the time lock protrusion 81 is moved along the rail 27 and returned to the state as illustrated in FIGS. 15 and 16. This is the double end projection state, which is the dead bolt function state.

Referring to FIGS. 16 and 17, when comparing the extents of the latch 10 entering into the main body 90, it is shown that the latch 10 is projected further in the double end projection state (i.e., dead bolt function state) than in the single end projection state (i.e., latch bolt function state).

When the inclined surface of the latch 10 is collided against the doorframe of the door and slid, the time lock protrusion 81 is moved along the guide surface 34 of the time lock locking jaw 29 by the force of the time lock spring 82 and when the time lock protrusion 81 is moved past the recess 32 formed in the surface of the time lock locking protrusion 29, the recess 32 performs the function of delaying the movement of the time lock protrusion 81.

While the inclined surface of the latch 10 collided against the doorframe of the door is being slid, when the force that pushes the door is not strong enough, the latch 10 may not be able to enter the doorframe hole of the door, in which case the door will not be closed. A problem may occur when the time lock protrusion 81 is brought into contact with the rail 27 and the locking device 300 enters into the dead bolt function state without the door being closed. Accordingly, the recess 32 can prevent the movement of the time lock protrusion 81 to the dead bolt function state, when the force that pushes the door is not strong enough.

The foregoing exemplary embodiments and advantages are merely exemplary and a variety of modifications may be enabled without departing from the technical scope of the present disclosure.

Accordingly, the present teaching is not to be construed as limiting the exemplary embodiments. The present teaching is to be interpreted by the claims appended hereto, and all the technologies within the equivalent scope are to be interpreted as being included in the scope of the present disclosure.

INDUSTRIAL APPLICABILITY

The present disclosure relates to a locking device capable of adjusting a backset distance and of rotation in both a forward direction and a reverse direction, and having both a dead bolt function and a latch bold function, and can be widely applied in a mechanical or electric door lock device.

What is claimed is:

1. A locking device capable of adjusting a backset, comprising:

a latch that is movable in a lengthwise direction, and rotatable about a longitude axis while the backset is adjusted in the lengthwise direction;

a holder inserted into the latch, a position of the latch relative to a position of the holder in the lengthwise direction being adjustable while the backset is adjusted;

an elastic member installed between the latch and the holder; and a zoom guide inserted into the latch and being fastened with the holder to fix the latch to the holder, the zoom guide being released from the latch so as to adjust the backset by rotating the latch.

2. The locking device of claim 1, wherein the holder comprises a latch insert on a front end thereof to be inserted into the latch, the latch insert comprises an inclined surface in the lengthwise direction, and a backset adjusting groove is formed in the inclined surface to be fastened with the zoom guide.

3. The locking device of claim 1, further comprising:

a main body to which the holder is inserted, the main body including a first guide groove, a second guide groove, and a fastening groove that are formed in a front end thereof; and a bracket comprising a bracket cylinder to receive the front end of the main body inserted therein, wherein, when the main body and the bracket are fastened, a cylinder guide formed on the bracket cylinder is moved along the guide groove to be fixed in the fastening groove.

4. A locking device, comprising;

a latch that is switchable between a dead bolt function and a latch bolt function;

a holder inserted into the latch; and a main body to which the holder is inserted, wherein the main body comprises a time lock interoperating with the holder, and the time lock is moved along a rail of the holder from a contact with the holder to an end of the rail, as the holder is moved into the main body by a rotation of a lever to open a door while the latch is in the dead bolt function, and the time lock is moved from the end of the rail as the holder is projected out of the main body by a counter rotation of the lever, past a first surface of a time lock locking jaw, to be locked in a second surface of the time lock locking jaw, so that when the door is opened, the latch is in the latch bolt function.

5. The locking device of claim 4, wherein, while the time lock is being locked in the second surface of the time lock locking jaw, when the latch is pressed and the holder is moved into the main body, the time lock is moved along a guide surface of the time lock locking jaw to a contact with the rail, so that when the door is closed, the latch is automatically changed to a dead bolt function from a latch bolt function.

6. The locking device of claim 4, wherein a time lock spring is installed on the time lock such that the time lock is subject to a force of the time lock spring that brings the time lock to the contact with the rail.

7. The locking device of claim 5, wherein the time lock locking jaw comprises a recess to delay the movement of the time lock.

8. The locking device of claim 5, wherein a time lock spring is installed on the time lock such that the time lock is subject to a force of the time lock spring that brings the time lock to the contact with the rail.

* * * * *